US009587536B2

(12) United States Patent
Belt

(10) Patent No.: US 9,587,536 B2
(45) Date of Patent: Mar. 7, 2017

(54) EXHAUST MUFFLER

(71) Applicant: Charles C. Belt, Montevideo, MN (US)

(72) Inventor: Charles C. Belt, Montevideo, MN (US)

(73) Assignee: Charles C. Belt, Montevideo, MN (US)

( * ) Notice: Subject to any disclaimer, the term of this patent is extended or adjusted under 35 U.S.C. 154(b) by 0 days.

(21) Appl. No.: 15/095,291

(22) Filed: Apr. 11, 2016

(65) Prior Publication Data

US 2016/0312673 A1 Oct. 27, 2016

Related U.S. Application Data

(60) Provisional application No. 62/153,238, filed on Apr. 27, 2015.

(51) Int. Cl.
*F01N 1/08* (2006.01)
*F01N 13/18* (2010.01)

(52) U.S. Cl.
CPC ..... *F01N 1/083* (2013.01); *F01N 1/08* (2013.01); *F01N 13/1872* (2013.01); *F01N 2450/20* (2013.01); *F01N 2450/22* (2013.01); *F01N 2450/24* (2013.01)

(58) Field of Classification Search
CPC ..... F01N 1/083
USPC ..... 181/264, 270, 279, 280, 281
See application file for complete search history.

(56) References Cited

U.S. PATENT DOCUMENTS 1,002,801 A * 9/1911 Boeck ..... F01N 1/08 181/264
1,085,203 A * 1/1914 Gipple ..... F01N 1/083 181/281
1,229,471 A * 6/1917 Jones ..... F01N 1/08 181/264
1,474,115 A * 11/1923 Heather ..... F01N 1/083 181/281
1,495,690 A * 5/1924 Hayes ..... F01N 1/083 181/263
1,804,070 A * 5/1931 Sykes ..... F01N 1/083 181/264

(Continued)

FOREIGN PATENT DOCUMENTS

WO WO-9817899 A1 4/1998

OTHER PUBLICATIONS

"Wave Frequency Oscillation (WFO) Muffler Description", 13 pgs.

*Primary Examiner* — Jeremy Luks
(74) *Attorney, Agent, or Firm* — Schwegman Lundberg & Woessner, P.A.

(57) ABSTRACT

A muffler for an exhaust system can comprise a muffler body including an exterior metal shell having an outer surface and an inner surface, a portion of the inner surface defining a gas chamber, the gas chamber having a first side portion and a second side portion; a plurality of baffles, each baffle coupled to the inner surface, each baffle extending from an outer end to an inner end the inner end of each baffle having a reflecting portion bent in a direction of gas flow, wherein a first baffle of the plurality of baffles is coupled to the first side portion and a second baffle of the plurality of baffles is coupled to the second side portion; a flow channel formed between the bent end of the first baffle coupled to the first side portion and the second baffle coupled to the second side portion; and a first plate assembly, coupled to the inner surface.

19 Claims, 10 Drawing Sheets

(56) References Cited

U.S. PATENT DOCUMENTS

| | | | | | |
|---|---|---|---|---|---|
| 1,998,386 | A * | 4/1935 | Powell | F01N 1/00 | 181/270 |
| 2,012,331 | A | 8/1935 | Alexander | | |
| 2,202,272 | A | 5/1940 | Smith | | |
| 2,392,247 | A | 1/1946 | Katcher | | |
| 2,511,359 | A * | 6/1950 | McLeod | F01N 1/083 | 181/262 |
| 2,609,886 | A | 9/1952 | Harmon | | |
| 2,723,723 | A | 11/1955 | Halliday et al. | | |
| 2,727,584 | A * | 12/1955 | Marx | F01N 1/083 | 181/270 |
| 2,894,599 | A | 7/1959 | Leininger | | |
| 2,903,085 | A | 9/1959 | Miller | | |
| 3,077,240 | A | 2/1963 | Betts | | |
| 3,092,206 | A | 6/1963 | Moreau | | |
| 3,176,791 | A | 4/1965 | Betts et al. | | |
| 3,187,834 | A | 6/1965 | Bryson et al. | | |
| 3,276,202 | A * | 10/1966 | Gary | F01N 1/083 | 422/174 |
| 3,354,986 | A | 11/1967 | Moss et al. | | |
| 3,811,531 | A | 5/1974 | Forssman | | |
| 3,963,092 | A | 6/1976 | Soares | | |
| 4,027,740 | A * | 6/1977 | Martin | F01N 3/08 | 181/281 |
| 4,167,987 | A | 9/1979 | Turner | | |
| 5,661,973 | A | 9/1997 | Casey | | |
| 5,739,484 | A | 4/1998 | Jones | | |
| 5,773,770 | A | 6/1998 | Jones | | |
| 6,364,054 | B1 * | 4/2002 | Bubulka | F01N 1/003 | 181/264 |
| 6,622,821 | B2 * | 9/2003 | Butler | F01N 1/08 | 138/109 |
| 8,746,401 | B2 * | 6/2014 | Butler | F01N 1/085 | 181/268 |
| 2009/0127025 | A1 * | 5/2009 | Rimback | F01N 1/02 | 181/282 |
| 2013/0199870 | A1 * | 8/2013 | Schooler | F01N 13/00 | 181/282 |

* cited by examiner

EXHAUST MUFFLER

CLAIM OF PRIORITY

This patent application claims the benefit of priority of Belt U.S. Provisional Patent Application Ser. No. 62/153,238, titled "Exhaust Muffler," filed on Apr. 27, 2015, which is hereby incorporated by reference herein in its entirety.

BACKGROUND

Noise suppression for internal combustion engines is extremely desirable. Too much constriction of exhaust flow can cause a loss of power.

OVERVIEW

The present inventor recognized a need for a muffler or noise suppressor for internal combustion engines that can maintain high performance, horsepower, efficiency, reliability, and provide a desirable engine sound. The present disclosure includes a muffler having a flow through channel, and a plurality of angled baffles. The angled baffles can include a curved radius or reflecting portion at an end of a baffle towards the center of the muffler. The baffles and the curved radius can be configured to reflect sound waves and provide noise abatement. The baffles can be attached to the interior sides of a muffler body and leave a straight pathway for airflow in the center of the muffler body. The muffler can include a portion having a stacked perforated plate assembly that can minimize high frequency exhaust noise. The perforated plate assemblies can be located in various configurations throughout the muffler body to control and affect the exhaust sound.

These and other examples and features of the present exhaust muffler system and methods will be set forth in part in the following Detailed Description. This Overview is intended to provide non-limiting examples of the present subject matter—it is not intended to provide an exclusive or exhaustive explanation. The Detailed Description below is included to provide further information about the present downdraft ventilation system (downdraft system) and methods.

BRIEF DESCRIPTION OF THE DRAWINGS

Corresponding reference characters indicate corresponding parts throughout the several views. The exemplifications set out herein illustrate exemplary embodiments of the invention, and such exemplifications are not to be construed as limiting the scope of the invention in any manner.

Figure 1:
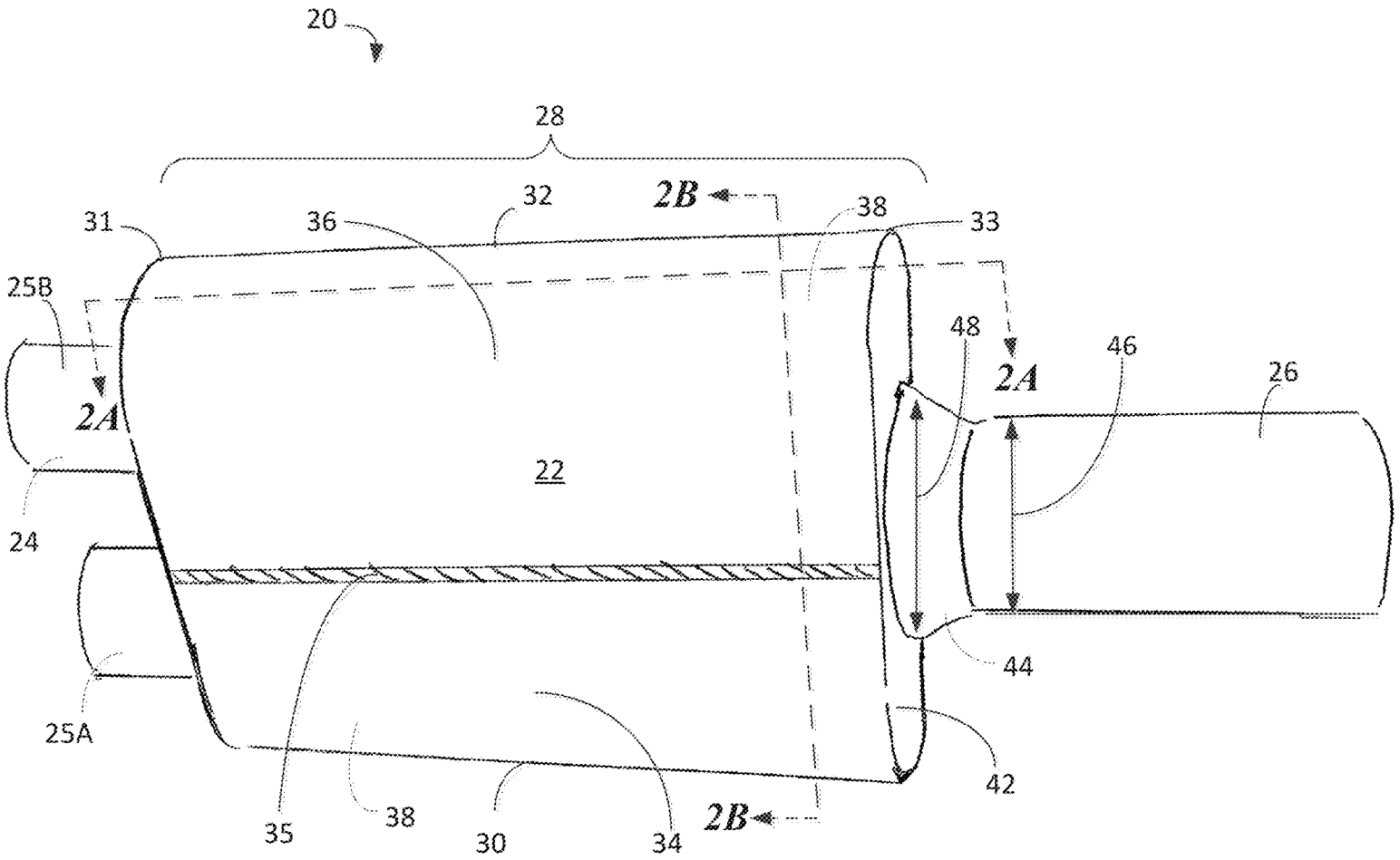
FIG. 1 illustrates an exhaust muffler, in accordance with at least one example of the present disclosure.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Mufflers can be placed in many locations and orientations in relation to an internal combustion engine. To orient the reader, this disclosure describes the exhaust muffler as having an inlet end as the end where exhaust gases enter the muffler, and an outlet end as the end where exhaust gases exit the muffler. The muffler can include a left side and a right side, but because there can be a variety of orientations, these will be noted as a first side and a second side. The terms top and bottom are used for descriptive purposes only.

Mufflers can include an exterior shape that can vary greatly. For the sake of description, this disclosure will describe the muffler as having a length that is measured from the inlet end to the outlet end, a width that is measured from the first side to the second side and a height that is measured from a top side to a bottom side.

Use of these conventions does not change the intent of this disclosure and the present inventor has contemplated the present exhaust muffler design in any shape, orientation, or location that is desirable or needed.

FIG. 1 illustrates an exhaust muffler 20 as viewed from a top side 22. The exhaust muffler 20 can include an inlet pipe 24, an outlet pipe 26, and a muffler body 28. The exhaust muffler 20 can allow exhaust gases that are expelled from an internal combustion engine to flow from the inlet pipe 24, into the muffler body 28, and exit the muffler body 28 via the outlet pipe 26. The muffler body 28 can include a first side 30, a second side 32, an inlet end 31, and an outlet end 33. The exhaust muffler 20 is illustrated as having a first inlet pipe 25A and a second inlet pipe 25B and a single outlet pipe 26, however any number of inlet pipes can be used and any number of outlet pipes can be used without changing the intent of the present disclosure.

The muffler body 28 can be divided into a first side portion 34 and a second side portion 36. The first side portion 34 and the second side portion 36 can be joined together by attachment processes such as welding, fastening, gluing, crimping, or forging. A center weld seam 35 is illustrated as joining the first side portion 34 and the second side portion 36.

As viewed from the exterior, the muffler body 28 can include an outer skin or shell 38, an inlet end cap 40 (see FIG. 2A) and an outlet end cap 42. The muffler body 28 can define a volume or space in fluid communication with the inlet pipe 24 and the outlet pipe 26. The interior of the muffler body 28 can include additional structures, as described below.

The shell 38 can be formed from one or more sheets of material. The material can be metal, alloys of metal, ceramic, polymer or a combination of materials. The shell 38 can be stainless steel. The shell 38 can be shaped using any material forming process, such as bending, machining, rolling, casting etc. In an example, the shape of the shell 38 can control the shape of the muffler body 28, which can be shaped into an elliptical cylinder as shown in FIG. 1. In an example, the muffler body 28 can be shaped as a cylinder, a rectangle, or a solid shape having an irregular cross section. The inlet end cap 40 and outlet end cap 42 can be fitted and coupled to each end of the shell 38. The first and second end caps 40, 42 can be coupled to the shell 38 by any fastening process such as welding, bolting, screwing, or crimping. The outlet pipe 26 can include an outlet flange 44 which can adapt a first diameter 46 of the outlet pipe 26 to a second diameter 48 of an outlet flange 44, that can couple to an aperture 50 (see FIG. 9A) in the outlet end cap 42. In an example, the outlet end cap can have multiple apertures and outlet pipes. The exhaust muffler 20 can be fully sealed so that no exhaust gases can escape from within the exhaust muffler 20 other than gases entering the inlet pipe 24 and exiting the outlet pipe 26. The inlet pipe 24 can also include an inlet flange.

Figure 2A:
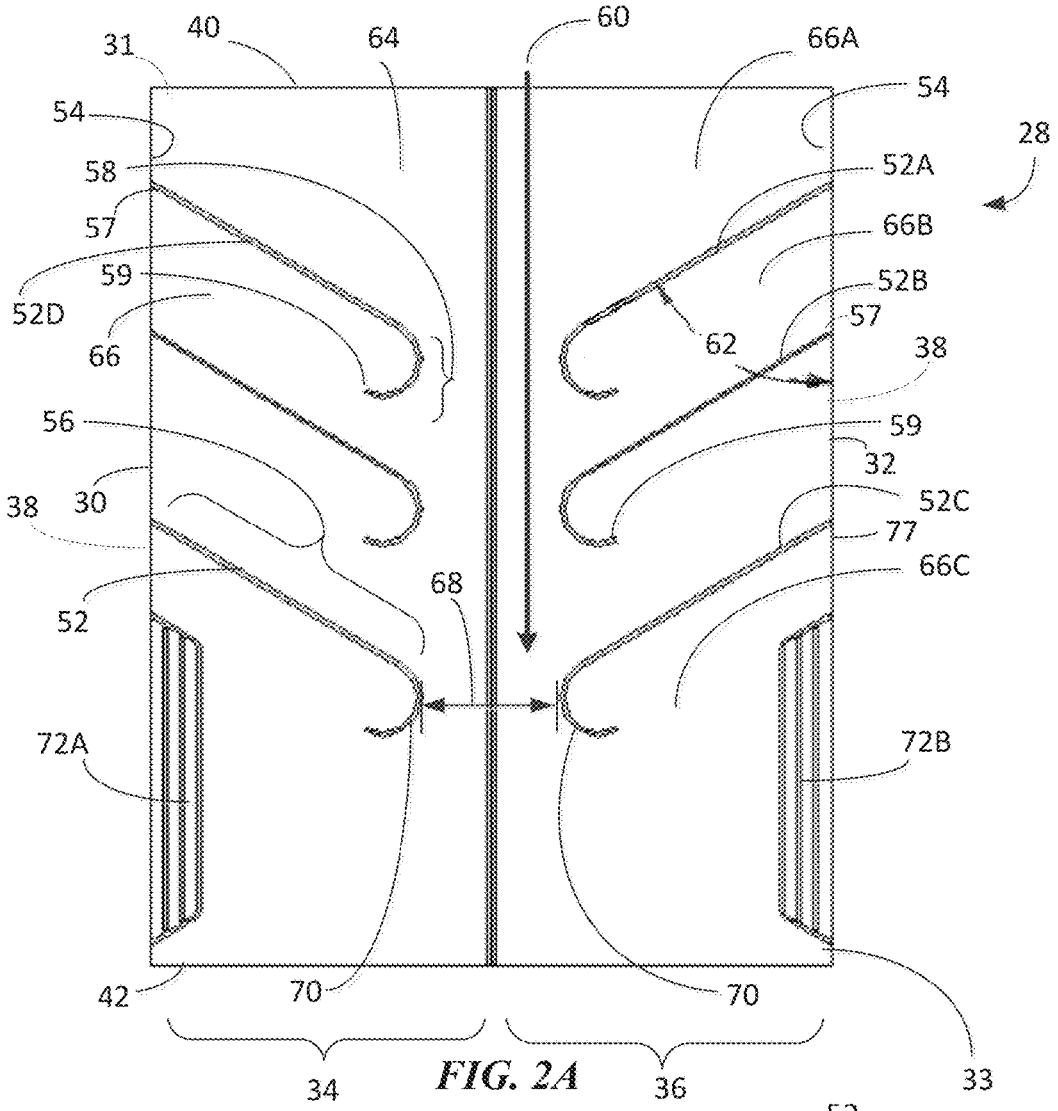
FIG. 2A illustrates a cross section of the muffler body as viewed from the top, in accordance with at least one example of the present disclosure.
Figure 2B:
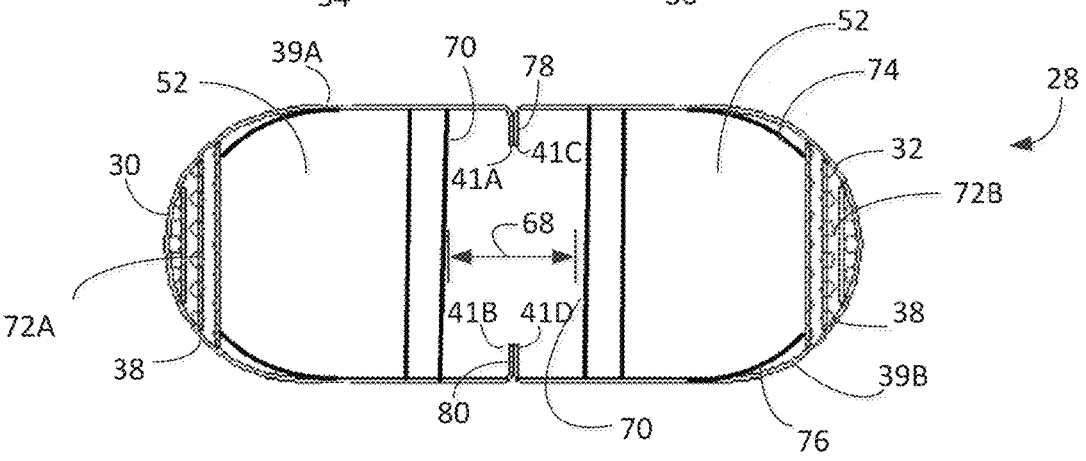
FIG. 2B illustrates a cross section of the muffler body as viewed from the outlet end, in accordance with at least one example of the present disclosure.

FIGS. 2A and 2B illustrate cross sectional views of the muffler body 28 shown in FIG. 1. FIG. 2A views the muffler body 28 in cross section from the top side 22 (see FIG. 1). The exhaust muffler 20 can include a plurality of baffles 52 coupled to an inner surface 54 of the shell 38. Note: throughout this application "baffles" are labeled with element number 52 and when referring to a specific baffle, it will have a suffix letter such as "52A". Each baffle 52 can extend from an outer end 57 to an inner end 59. In an example, each baffle 52 can include a planar portion 56 and a reflecting portion 58. In an example, at least one baffle 52 of the plurality of baffles can include a planar portion 56 and a reflecting portion 58. The reflecting portion 58 can be located near the inner end 59 of the baffle 52 and can be integral or coupled to the baffle 52. The reflecting portion 58 can be bent, shaped, formed, or curved in the direction of flow 60. The reflecting portion 58 can include a smoothly curved radius as shown, or can be formed as one or more straight portions that are bent in the direction of flow 60 and can approximate a curve. Forming the ends of baffles 52 in this direction allows a great portion of the exhaust gases to flow through the muffler body 28 in an unobstructed manner. Keeping the exhaust gases unobstructed can prevent engine power loss caused by exhaust back pressure. The planar portion 56 of the baffle 52 can be coupled to the shell 38 at an angle 62 to the first side 30 or second side 32 of the muffler body 28. The angle 62 can be between about 30 to about 90 degrees. A lower angle can allow the exhaust gases to flow with less obstruction by the baffle 52. A series of multiple baffles can be at the same angle or at various angles. In an example, all of the baffles can be attached at an angle of 60 degrees. In an example, a middle pair of baffles (pair denoting first and second sides) can be attached at 60 degrees, a forward pair of plates can be attached at 90 degrees and a rear pair of baffle plates can be attached at 30 degrees. Changing the placement, angle, size and number of the baffle plates can be altered to provide the noise suppression required and/or the tune of the resultant exhaust system.

The shell 38 can enclose a space and define a gas chamber 64. The gas chamber 64 can be an expanded volume between the inlet pipe 24 and the outlet pipe 26 (see FIG. 1). The gas chamber 64 can include all areas within the muffler body 28 that are in fluid communication. The gas chamber 64 can be divided into sub-chambers 66 that can be created by the positioning of the baffles 52. One or more baffles 52 can be attached to the first side 30 and one or more baffles can be attached to the second side 32. In an example, the baffles 52 can be generally across from each other. Sub-chambers 66 can be formed between two baffles 52 or between a baffle 52 and the inlet end cap 40 or the outlet end cap 42. In an example, in the second side portion 36, a first sub-chamber 66A can define an area between a first baffle 52A and the inlet end cap 40. A second sub-chamber 66B can define an area between the first baffle 52A and a second baffle 52B. A third sub-chamber 66C can define an area between a third baffle 52C and the outlet end cap 42. Similar sub-chambers can be defined on the first side portion 34.

A flow channel 68 can be formed between inner edges 70 of baffles 52 attached to the first side 30 and inner edges 70 of baffles 52 attached to the second side 32. In an example, the flow channel 68 can be substantially straight and the inner edges 70 of the reflecting portion 58 of the baffles can be all aligned. In another example, the inner edges of baffles are not aligned and the flow channel can take a more irregular path.

One or more plate assemblies, such as a first plate assembly 72A and a second plate assembly 72B can be located in the gas chamber 64. Each of the first and second plate assemblies 72A, 72B can be an assembly of stacked perforated plates and is described in further detail below. Note: throughout this application "plate assemblies" are labeled with element number 72 and when referring to a specific plate assembly, such as a first plate assembly, it will have a suffix letter such as "72A". In an example, the first plate assembly 72A can be located on the first side 30 near the outlet end 33 of the muffler body 28. The plates forming the plate assembly 72A can be substantially parallel to the flow channel 68. In an example, the second plate assembly 72B can be located on the second side 32 near the outlet end 33 of the muffler body 28. The first and second assemblies 72A, 72B can provide noise dampening of high frequency exhaust noises. The first and second plate assemblies 72A, 72B are illustrated as being coupled to first and second side walls of the gas chamber 64. Other locations of a plate assembly 72 are contemplated by the present inventor without changing the scope of this disclosure. In an example, a plate assembly 72 can be located in an upper or lower surface of the gas chamber 64. In an example, one or more plate assemblies 72 can be located anywhere within the gas chamber 64, such as between two baffles 52 or in an area forward of any baffles 52, such as near the inlet end 31.

As described above, the muffler body 28 can include a first side portion 34 and a second side portion 36. The first side portion 34 and the second side portion 36 can be mirror images of each other. For example, the muffler body 28 can include a fourth baffle 52D attached to the first side 30 generally across from the flow channel 68 from the first baffle 52A attached to the second side 32. The positions of the first and second plate assemblies 72A, 72B on the first side portion 34 and the second side portion 36 can also be mirror images.

FIG. 2B illustrates a cross section of the muffler body 28 of FIG. 1 viewed from the outlet end 33. The muffler body 28 can be configured so that the flow channel 68 can provide an unobstructed pathway for exhaust gases to travel from the inlet end 31 to the outlet end 33 (see FIG. 2A). Baffles 52 can be coupled to the inner surface 54 of the shell 38 along outer edges of the baffle 52 such as a top edge 74, a bottom edge 76 and a side edge 77 (see FIG. 2A). The inner edge 70 of the baffle 52 can remain unattached. The first and second plate assemblies 72A, 72B are illustrated as coupled to the first side 30 and second side 32 of the muffler body 28. The shell 38 can be formed in two halves and joined at top and bottom flanges 78, 80. The top flange 78 and bottom flange 80 can include a right angle bend so that a surface formed by the top and bottom flanges 78, 80 can be generally perpendicular to a top surface and a bottom surface of the muffler body 28. In an example, the first side shell 39A can extend from a first end 41A to a second end 41B, and a second side shell 39B can extend from a third end 41C to a fourth end 41D.

Figure 3:
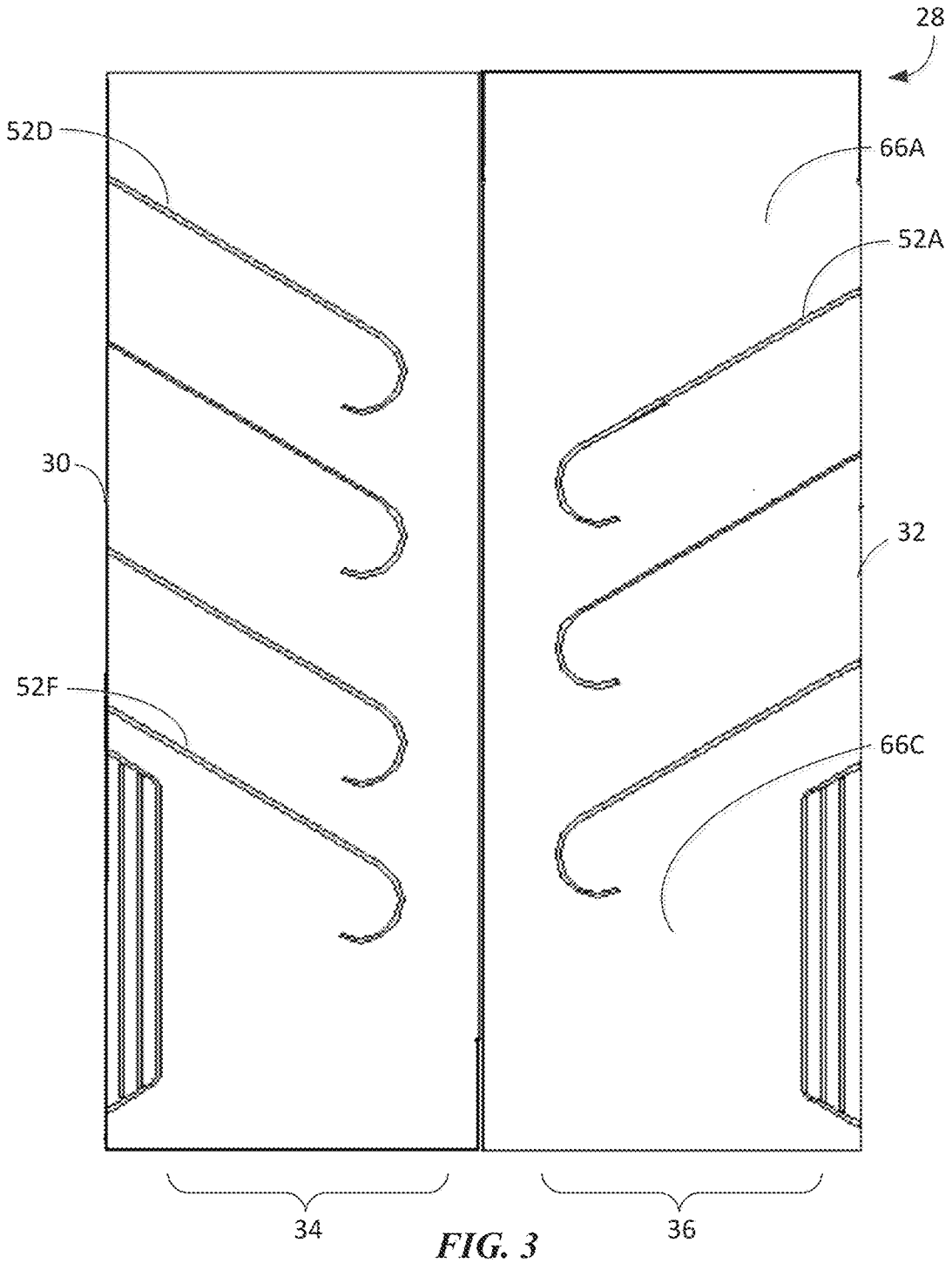
FIG. 3 illustrates a cross section of the muffler body as viewed from the top, in accordance with at least one example of the present disclosure.

FIG. 3 illustrates an example of a muffler body 28 having offset baffles 52. In an example, the first side portion 34 and the second side portion 36 are not mirror images. Instead of having the first baffle 52A generally across from the fourth baffle 52D on the first side 30 and the second side 32; the fourth baffle 52D can be generally across from the first sub-chamber 66A. In another example, a fifth baffle 52F can be generally across from the third sub-chamber 66C.

Figure 4:
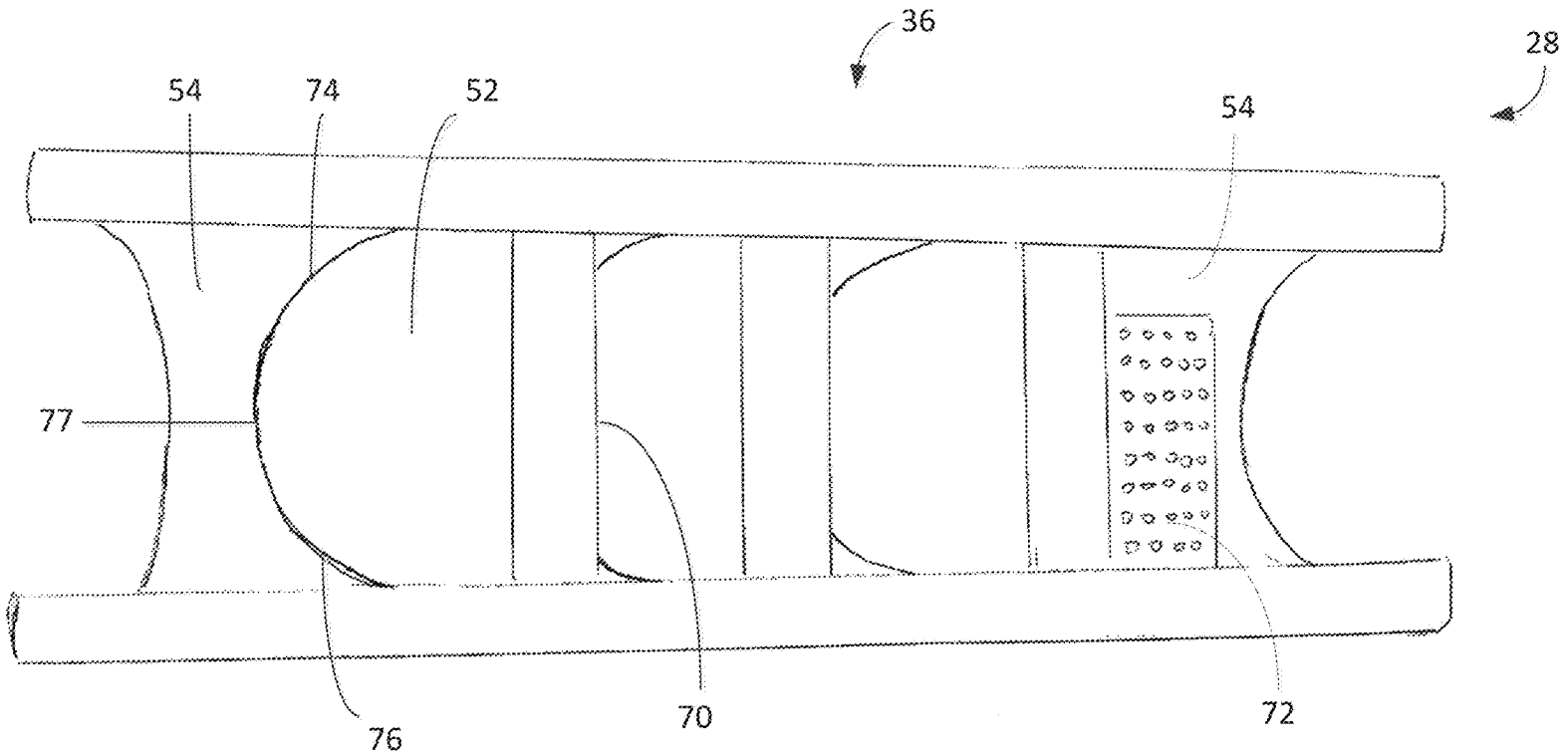
FIG. 4 illustrates a perspective view of a muffler body half portion, in accordance with at least one example of the present disclosure.

FIG. 4 illustrates a perspective view of a second side portion 36 of a muffler body 28. The outer shape of the baffle 52 can be formed to match the inner shape of the inner surface 54. Except for the inner edge 70, all edges of the baffle 52, such as the top edge 74, bottom edge 76, and side edge 77 can be coupled to and sealed against the inner surface 54, such as by welding, so that exhaust gases are forced to travel through the flow channel 68 (See FIGS. 2A-B). The exhaust muffler 20 (see FIG. 1) can be any size required for any size engine. The muffler body 28 can be lengthened or shortened depending on noise reduction and sound tuning needs. The muffler body 28 can include at least two baffles 52 and can include an unlimited number of baffles 52 if needed. A plate assembly 72 can be coupled to the inner surface 54.

Figure 5A:
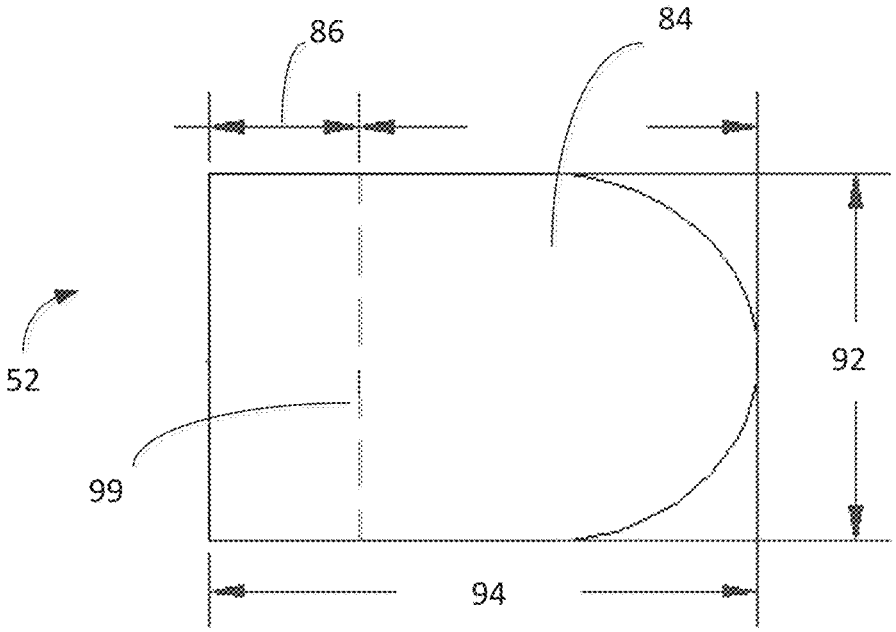
FIG. 5A illustrates a baffle, in accordance with at least one example of the present disclosure.
Figure 5B:
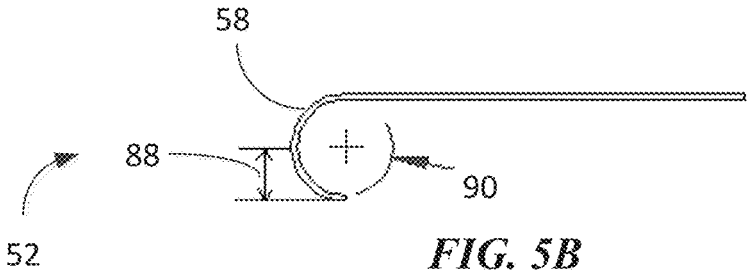
FIG. 5B illustrates a cross section of a baffle, in accordance with at least one example of the present disclosure
Figure 5C:
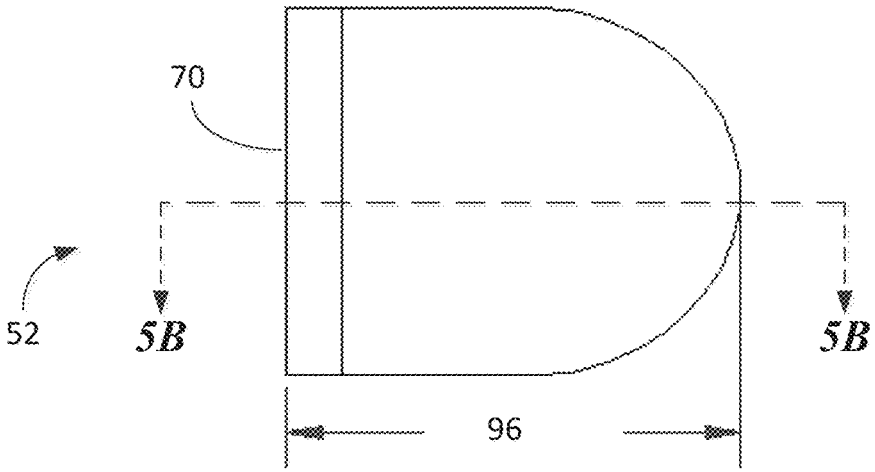
FIG. 5C illustrates a baffle, in accordance with at least one example of the present disclosure.

FIG. 5A illustrates a baffle 52 prior to formation of the reflecting portion 58. The manufacturing process can begin with a flat plate 84 cut to fit the inner surface 54 of the muffler body 28, (see FIG. 4) such as part of an oval shape. The flat plate 84 is illustrated with a bend line 99 that indicates where the flat plate 84 can be formed into a baffle 52 with a reflecting portion 58. The bend dimension 86 can be a width of material that can be bent, rolled, shaped, or formed into the reflecting portion 58 illustrated in FIG. 5B. The reflecting portion 58 can act to reflect sound waves inside of the gas chamber 64 (See FIG. 6). The sound waves can be reflected in a direction away from the flow channel 68. Although the reflecting portion 58 is illustrated in FIG. 5B as a regular circular arc having a radius 88 and 180 degrees of curvature 90, the reflecting portion 58 can be angular, irregular or having combinations of curved and straight portions. The reflecting portion 58 can be a regular circular arc having a radius between about 0.25 to about 1.25 inches and an arc of curvature 90 between about 90 to about 270 degrees. The following baffle dimensions are described as though installed into the muffler body 28 (see FIG. 2B). In an example the baffle 52 can have a height dimension 92 between about 3 to about 5 inches, a width dimension 94 between about 4 to about 7 inches (before bending). In an example, the radius 88 can be 0.5 inches and the arc of curvature 90 can be about 180 degrees. FIG. 5C illustrates the baffle 52 after the reflecting portion 58 has been formed. The baffle 52 can include an after bending width 96 between about 3 to about 6 inches. The baffle 52 can be attached to the inner surface 54 of the muffler body 28 (see FIG. 4) all along the outer edges except for the inner edge 70. The baffle 52 can be formed of multiple parts that can be coupled together or can be formed of one piece. The foregoing dimensional ranges do not preclude forming an exhaust muffler of any size using the devices and methods disclosed herein and any size exhaust muffler using these devices and methods has been contemplated by the present inventor.

The reflecting portion 58 can be formed so that the inner edge 70 does not obstruct the main flow of exhaust gases in the muffler body 28. The height dimension of the flat plate 84 can equal the dimension between the top and bottom surfaces of the shell 38 (See FIG. 2B). FIG. 5C illustrates a top view of the baffle 52 after the reflecting portion 58 has been formed. The after bending width 96 of the baffle 52 can be configured to form the dimensions of the flow channel 68 and also the volume and size of a sub-chamber, such as 66B (See FIG. 2A).

Figure 6:
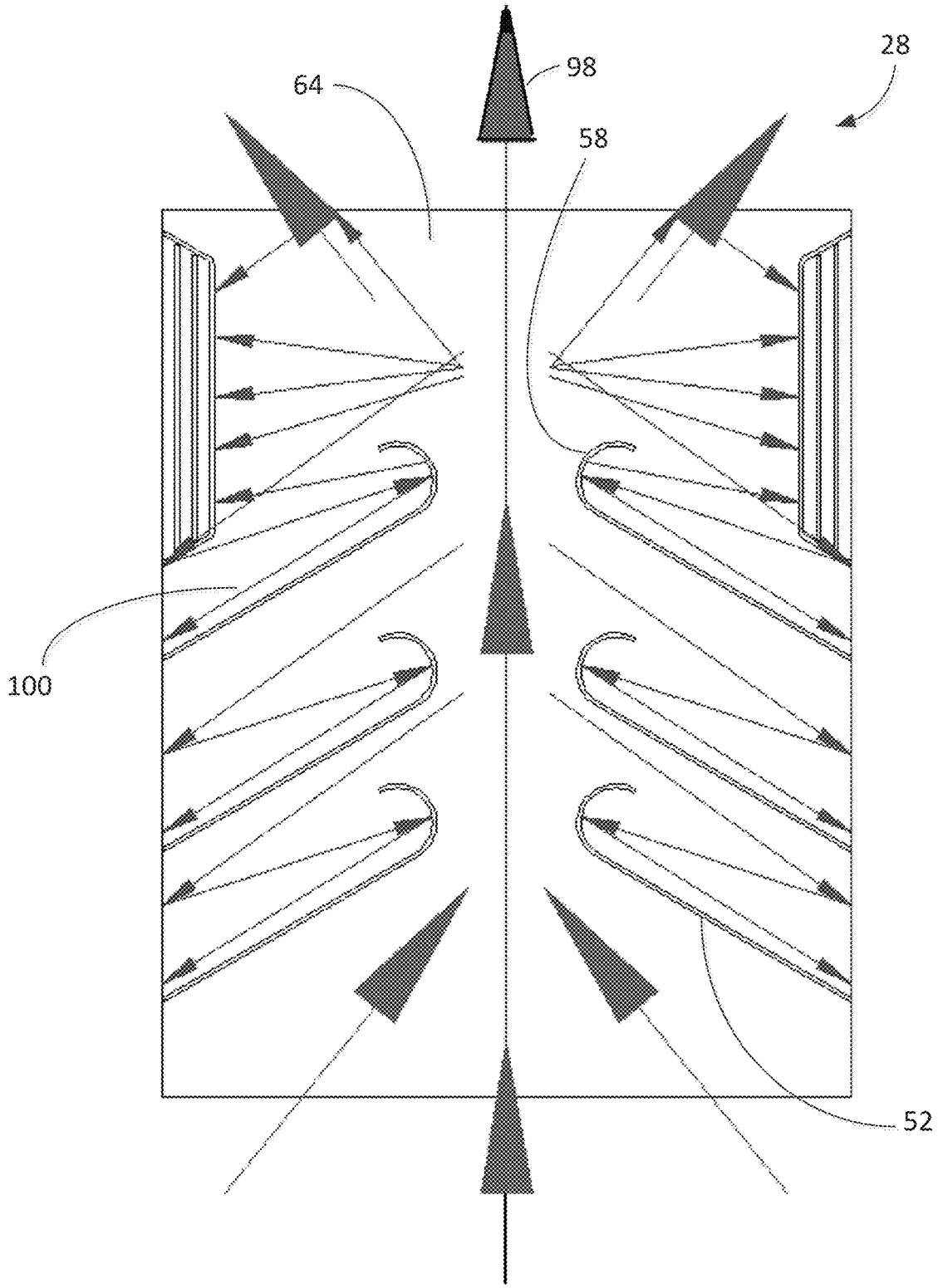
FIG. 6 is a schematic of the muffler body cross section of FIG. 2A showing possible airflow and sound wave patterns, in accordance with at least one example of the present disclosure.

FIG. 6 shows an example of possible pressure wave flows in the gas chamber 64 of a muffler body 28. The large arrows 98 represent the main flow path of the exhaust gas. The smaller arrows 100 represent portions of the gas flow redirected from the main gas flow. The reflecting portions 58 and the baffles 52 serve to form surfaces that can redirect sound waves. The redirected waves can produce noise suppression or tonal changes in the exhaust sound.

Figure 7A:
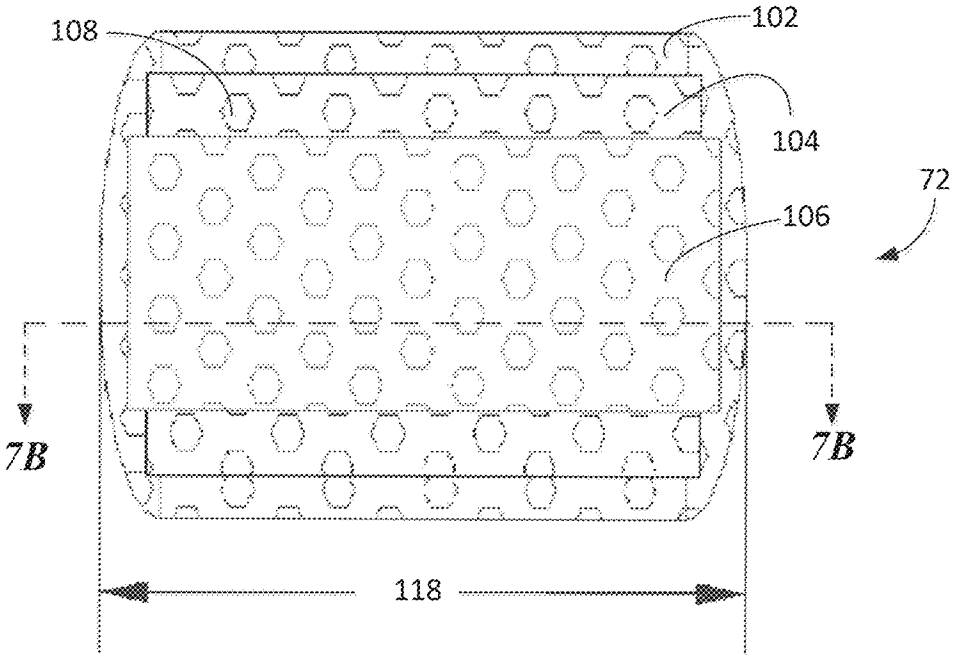
FIG. 7A illustrates a top view of a plate assembly, in accordance with at least one example of the present disclosure.

FIG. 7A illustrates a plate assembly 72, viewed from a side that can be attached to the inner surface 54 of the muffler body 28 (see FIG. 2B). The plate assembly 72 can include a first plate 102, a second plate 104, and a third plate 106. In an example, the first plate 102 can be configured to form an attachment structure to attach the plate assembly 72 to an inner surface 54 of the muffler body 28 (see FIG. 2A). Any of the first, second, or third plates 102, 104, 106 can include a plurality of plate apertures 108. The plate apertures 108 can be hexagonal shapes, round shapes, polygonal shapes, irregular shapes, regular shapes, or a combination of shapes and can add perforations to the plates that can diffuse sound waves.

Figure 7B:
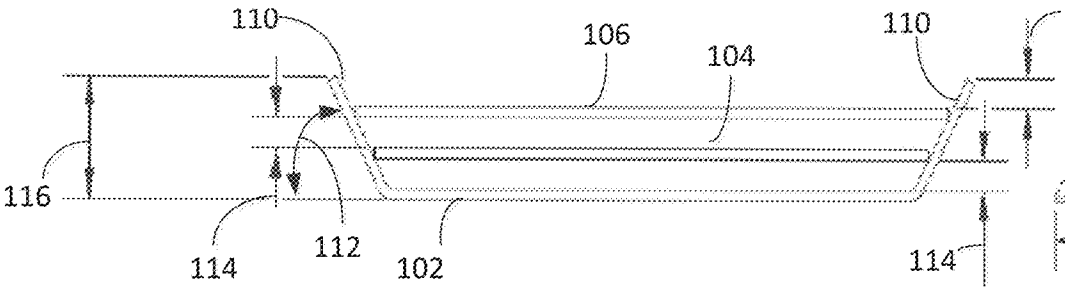
FIG. 7B illustrates a cross section view of FIG. 7A, in accordance with at least one example of the present disclosure.
Figure 7C:
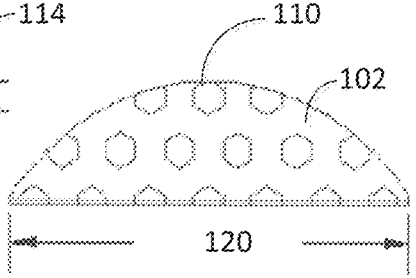
FIG. 7C illustrates an end view of a plate assembly, in accordance with at least one example of the present disclosure.

FIG. 7B illustrates a cross section view of FIG. 7A, in accordance with at least one example of the present disclosure. FIG. 7B illustrates outer ends 110 of the first plate 102 bent upwardly. The bend can be towards the inner surface 54 of the muffler body 28 (see FIG. 2B) and the second plate 104 and the third plate 106 can be attached to the first plate 102. FIG. 7C shows the outer end 110 of the first plate 102 can be shaped to match the shape of the inner surface 54 of the muffler body 28 (see FIG. 2A). The plate assembly 72 can be coupled to the inner surface 54, by any coupling means, such as by welding, bolting, or crimping.

Figure 8A:
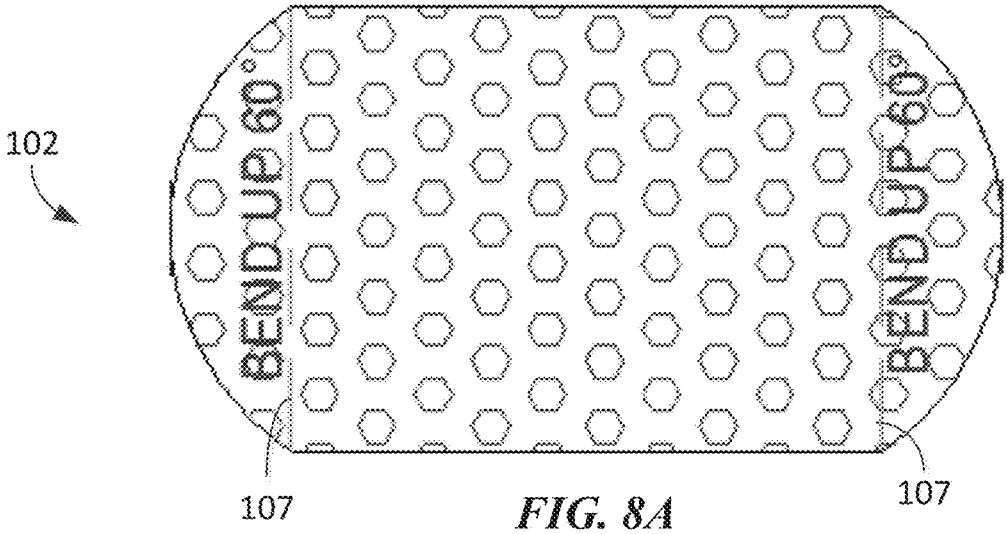
FIG. 8A illustrates a first plate of a plate assembly, in accordance with at least one example of the present disclosure.
Figure 8B:
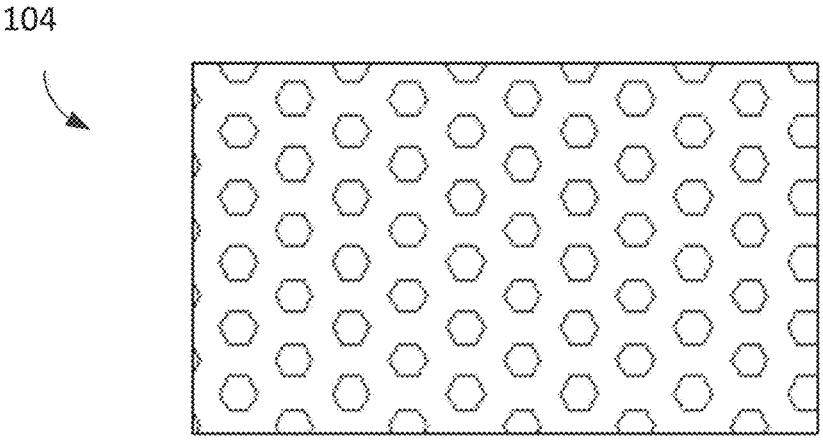
FIG. 8B illustrates a second plate of a plate assembly, in accordance with at least one example of the present disclosure.
Figure 8C:
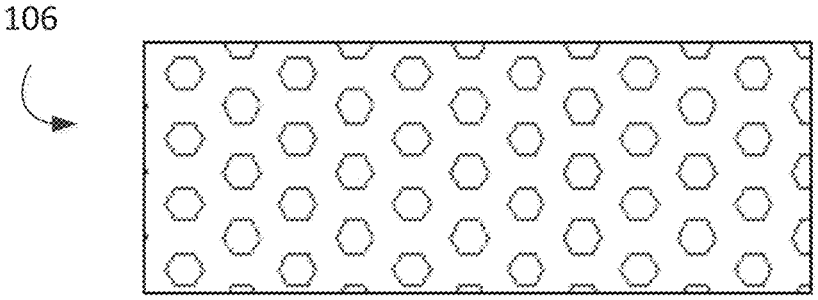
FIG. 8C illustrates a third plate of a plate assembly, in accordance with at least one example of the present disclosure.

Returning to FIGS. 7A and 7B, the bend of the first plate 102 can include a bend angle 112 between about 30 to about 90 degrees. For a set length of third plate 106 and second plate 104, changing the bend angle 112 of the bend on the outer end 110 can influence the spacing 114 between the first, second, and third plates 102, 104, 106. For example, a bend angle 112 that is wider can cause a spacing 114 that is greater and a lower bend angle can cause a spacing 114 that is less. The height 116 of the plate assembly 72 can be between about 0.5 to about 1.5 inches. In an example, the height 116 can be between about 0.3 to about 3 inches. The height 116 can be adjusted to include more or less than two inner plates. In an example, the plate assembly 72 only includes one plate. Any of the plate assembly 72 dimensions such as length 118, height 116, or width 120 can be configured to affect the amount of noise suppression or tonal quality of the exhaust sound FIGS. 8A-C illustrate a first plate 102, a second plate 104 and a third plate 106. The first plate 102 is shown in an unbent condition and as having a bend line 107 at each end. In an example, the first plate 102 can have a greater width than the second plate 104 and the third plate 106 due to a location towards the center of the muffler body 28 (e.g. an oval muffler body). In an example, the third plate 106 can be located at a narrower portion of the inner surface and can have the smallest width of the plates, since it can be located closest to the side of the muffler body 28 (see FIG. 2B). If the bend angle of the first plate 102 is something other than 90 degrees, the length of the second plate 104 and the third plate 106 can be different. In an example shown in FIG. 7B, the first plate 102 has a bend angle 112 of about 60 degrees and the third plate 106 is longer than the second plate 104.

Figure 9A:
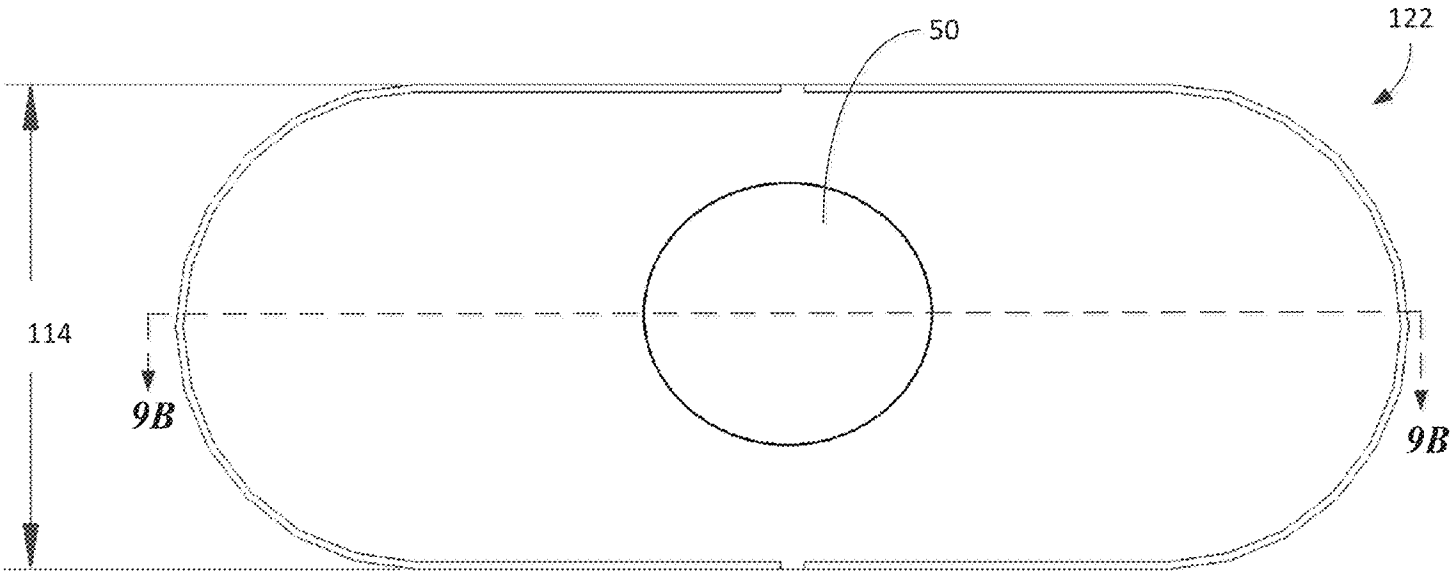
FIG. 9A illustrates a plan view of an end cap, in accordance with at least one example of the present disclosure.
Figure 9B:
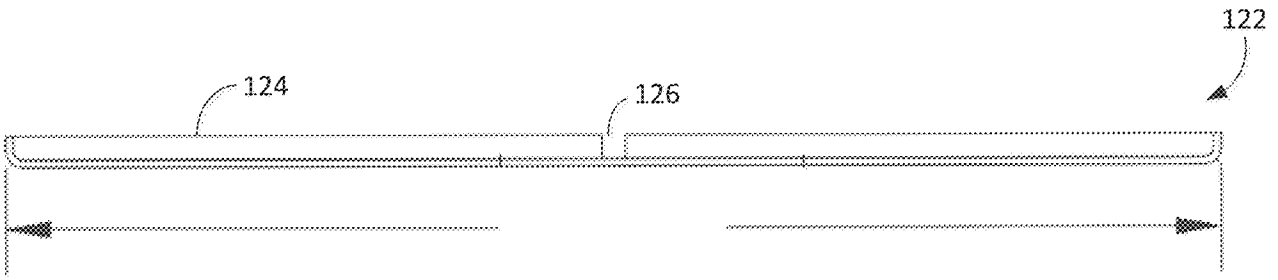
FIG. 9B illustrates a cross section view of FIG. 9A, in accordance with at least one example of the present disclosure.

FIGS. 9A-B illustrate an end cap 122. The end cap 122 can include an aperture 50 for either an inlet pipe 24 or outlet pipe 26 (see FIG. 1). The location of the aperture 50 can be varied according to airflow, noise suppression, and/or structural mounting requirements as required by the exhaust system. The end cap 122 can include an attachment flange 124 that can be configured for attachment to the muffler body 28 (see FIG. 1) by welding, bolting or crimping. The attachment flange 124 can include a notch 126 to allow clearance for the top flange 78 and bottom flange 80 of the muffler body 28 (see FIG. 2B).

Figure 10:
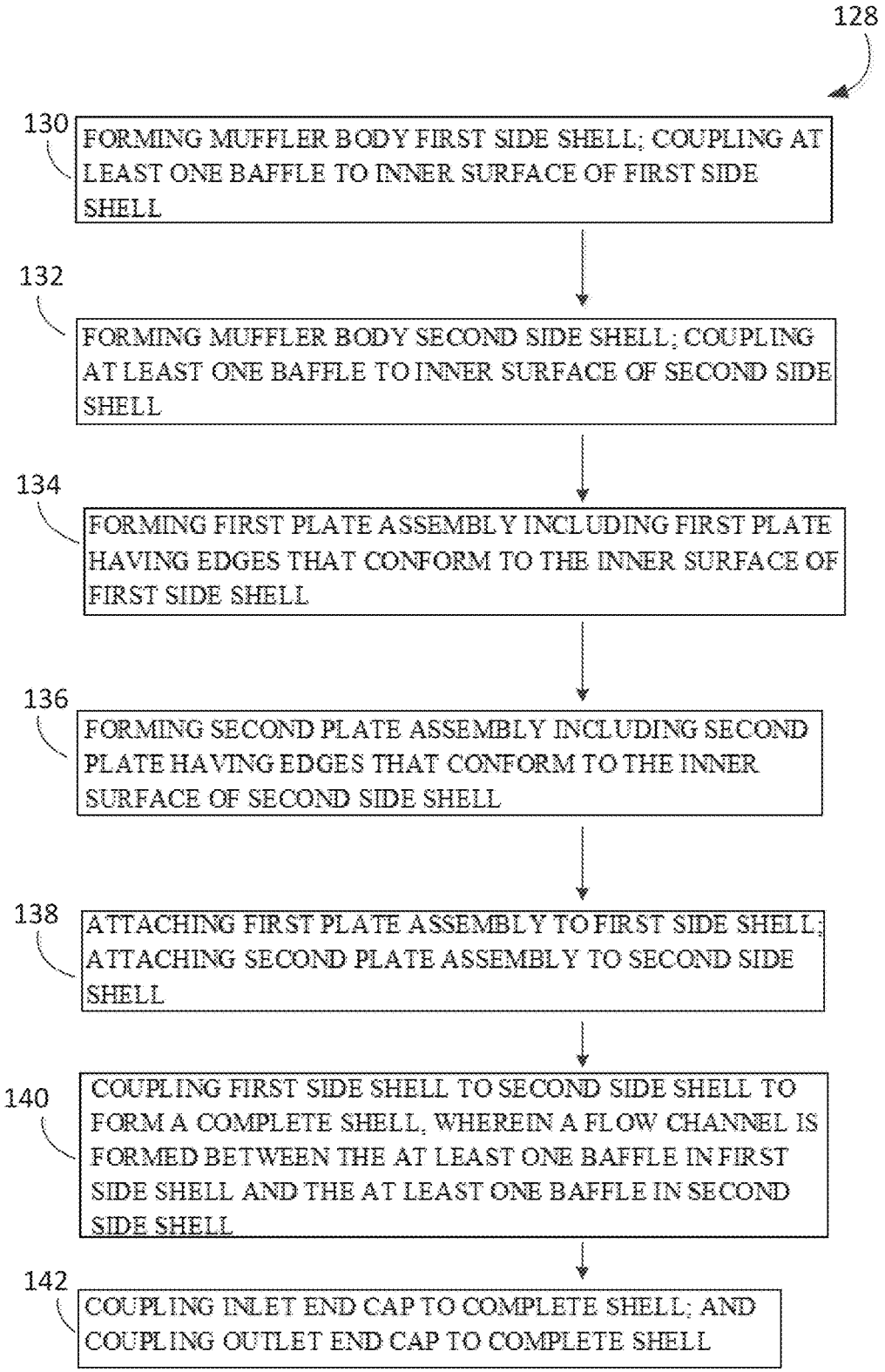
FIG. 10 illustrates a method of manufacturing a muffler, in accordance with at least one example of the present disclosure.

FIG. 10 illustrates a method of manufacturing a muffler 128. Forming muffler body first side shell; coupling at least one baffle to inner surface of the first side shell 130 can include forming the shell into half shapes such as half an oval, half a rectangle, half a cylinder as described above. The shell can extend from a first end to a second end and can have a first flange on the first end and a second flange on the second end. The at least one baffle can be attached to the first inner surface at an angle. The at least one baffle can include a reflecting portion that can be located on the end of the baffle disposed near a flow channel. The reflecting portion can be curved in the direction of gas flow. Such a direction of curve can be less disruptive to the gas flow. Forming a muffler body second side shell; coupling at least one baffle to the inner surface of second side shell 132 can include forming a second side shell that is a mirror image of the first side shell. In another example the second side shell, can be different than the first side shell, having a different number of baffles or locations of baffles.

Forming a first plate assembly including a first plate having edges that conform to the inner surface of the first side shell 134 can include all the configurations of the plate assemblies described above. The plate assemblies can include one or more perforated plates. Forming a second plate assembly including a second plate having edges that conform to the second side shell 136 can include all the configurations of the plate assemblies described above. Attaching the first plate assembly to the first side shell; and attaching second plate assembly to the second side shell 138 can be accomplished by welding or other means as described above. The plate assemblies can be located near the outlet end of the muffler body. In another example, the plate assemblies can be located near the inlet end of the muffler body, or in between baffles. The plate assemblies can suppress some of the higher frequency sounds created by the engine.

Coupling the first side shell to the second side shell to form a complete shell, wherein a flow channel is formed between the at least one baffle in the first side shell and the at least one baffle in the second side shell 140 provides a method of forming the muffler body. Coupling an inlet end cap to the complete shell; and coupling an outlet end cap to the complete shell 142 can complete the formation of the muffler body and allows each half of the muffler body to be formed as a complete unit before welding the halves together and attaching the end caps. The muffler halves and the end caps can be coupled by various means as described above.

Various Notes & Examples

To further illustrate the EXHAUST MUFFLER disclosed herein, a non-limiting list of examples is provided here:

In Example 1, a muffler for an exhaust system can comprise: a muffler body including an exterior metal shell having an outer surface and an inner surface, a portion of the inner surface defining a gas chamber, the gas chamber configured such that exhaust gases flow in a direction from an inlet end to an outlet end, the gas chamber having a first side portion and a second side portion; a plurality of baffles, each baffle coupled to the inner surface, each baffle extending from an outer end to an inner end, the inner end of at least one of the plurality of baffles having a reflecting portion bent in the direction of gas flow, wherein a first baffle of the plurality of baffles is coupled to the first side portion and a second baffle of the plurality of baffles is coupled to the second side portion; a flow channel formed between the bent end of the first baffle coupled to the first side portion and the second baffle coupled to the second side portion; and a first plate assembly, coupled to the inner surface, the first plate assembly having a planar surface substantially parallel to the flow channel.

In Example 2, the muffler of Example 1 can optionally be configured such that a number of baffles coupled to the first side portion is equal to a number of baffles coupled to the second side portion.

In Example 3, the muffler of Example 1 can optionally be configured such that the first side portion includes an even number of baffles and the second side portion includes an odd number of baffles.

In Example 4, the muffler of any one or any combination of Examples 1-3 can optionally be configured such that the reflecting portion of the at least one baffle coupled to the first side portion is generally across from a reflecting portion of a corresponding baffle coupled to the second side portion.

In Example 5, the muffler of any one or any combination of Examples 1-3 can optionally be configured such that the reflecting portion of the at least one baffle coupled to the first side portion is generally across from a space defined by at least one baffle coupled to the second side portion and one of a second baffle coupled to the second side portion and an end cap.

In Example 6, the muffler of any one or any combination of Examples 1-5 can optionally be configured such that the muffler body, the plurality of baffles and the first plate assembly include stainless steel.

In Example 7, the muffler of any one or any combination of Examples 1-6 can optionally be configured such that the reflecting portion includes a radius between about 0.25 to about 0.75 inches and from the beginning of the reflecting portion to the end of the reflecting portion forms an arc of curvature between about 120 to about 220 degrees.

In Example 8, the muffler of any one or any combination of Examples 1-7 can optionally be configured to further comprise a welded center seam joining the first side portion to the second side portion.

In Example 9, the muffler of any one or any combination of Examples 1-8 can optionally be configured to further comprise an inlet end cap and an outlet end cap, the inlet end cap coupled to the inlet end of the muffler body and defining an intake aperture, the outlet end cap coupled to the outlet end of the muffler body and defining an exhaust aperture.

In Example 10, the muffler of any one or any combination of Examples 1-9 can optionally be configured to further comprise an inlet pipe coupled to the inlet end cap and an outlet pipe coupled to the outlet end cap.

In Example 11, the muffler of any one or any combination of Examples 1-10 can optionally be configured such that the muffler body includes a longitudinal axis substantially parallel to sides of the muffler body and each baffle is attached to the inner surface of the muffler body such that a planar portion of the baffle is at an angle in the between about 30 to about 90 degrees to the longitudinal axis.

In Example 12, the muffler of any one or any combination of Examples 1-11 can optionally be configured such that the first plate assembly includes a stacked configuration of a first plate located adjacent the flow channel, a second plate, and a third plate having a planar surface located adjacent the exterior metal shell, the second plate located between the first plate and the third plate.

In Example 13, the muffler of Example 12 can optionally be configured such that the first plate includes a bent portion at each end, the bent portion coupled to ends of the second plate and the third plate.

In Example 14, the muffler of any one or any combination of Examples 1-13 can optionally be configured such that the first plate assembly includes a plurality of perforations in the planar surface.

In Example 15, the muffler of any one or any combination of Examples 1-14 can optionally be configured to further comprise a second plate assembly, coupled to the inner surface, the second plate assembly having a planar surface substantially parallel to the flow channel.

In Example 16, a muffler for an exhaust system can comprise: a muffler body including an exterior metal shell having an outer surface and an inner surface, a portion of the inner surface defining a gas chamber, the gas chamber configured such that exhaust gases flow in a direction from an inlet end to an outlet end, the gas chamber having a first side portion and a second side portion; an inlet end cap having an intake aperture, the inlet end cap coupled to the inlet end of the muffler body; an outlet end cap having an exhaust aperture, the outlet end cap coupled to the outlet end of the muffler body; a plurality of baffles, each baffle coupled to the inner surface, each baffle extending from an outer end to an inner end, the inner end of at least one of the plurality of baffles having a reflecting portion bent in the direction of gas flow, wherein a first baffle of the plurality of baffles is coupled to the first side portion and a second baffle of the plurality of baffles is coupled to the second side portion; a longitudinal axis substantially parallel to sides of the muffler body, wherein each baffle is attached to the one of the first side and the second side of the muffler body such that a planar portion of the baffle is at an angle between about 30 to about 90 degrees to the longitudinal axis; a flow channel formed between the bent ends of the first at least one baffle coupled to the first side portion and the second at least one baffle coupled to the second side portion; a first plate assembly having a planar surface substantially parallel to the flow channel, the first plate assembly coupled to the left portion near the outlet end of the muffler body; and a second plate assembly having a planar surface substantially parallel to the flow channel, the second plate assembly coupled to the right portion near the outlet end of the muffler body.

In Example 17, the muffler of Example 16 can optionally be configured such that the first side portion includes an even number of baffles and the second side portion includes an odd number of baffles.

In Example 18, a method of manufacturing a muffler can comprise: forming a muffler body first side shell extending from a first end to a second end, the first end having a first flange, the second end having a second flange; coupling at least one baffle to a first inner surface of the first side shell, the at least one baffle extending from an outer end to an inner end, the inner end bent in a direction of exhaust flow, the at least one baffle attached at an angle to the first inner surface, wherein the angle is in between about 50 to about 70 degrees; forming a muffler body second side shell extending from a third end to a fourth end, the third end having a third flange, the fourth end having a fourth flange; coupling at least one baffle to a second inner surface of the second side shell, the at least one baffle extending from an outer end to an inner end, the inner end bent in a direction of exhaust flow, the at least one baffle attached at an angle to the second inner surface, wherein the angle is in between about 50 to about 70 degrees; forming a first plate having edges that conform to the first inner surface; bending the edges of the first plate to define a space for location of a second plate and a third plate; attaching the second plate and the third plate to the first plate; attaching the first plate to the first inner surface; cutting at least one aperture in an inlet end cap; cutting at least one aperture in an outlet end cap; coupling the first side shell to the second side shell to form a complete shell; coupling the inlet end cap to the complete shell; and coupling the outlet end cap to the complete shell.

In Example 19, the method of Example 18 can optionally be configured such that the bent inner end of the at least one baffle includes a radius between about 0.25 to about 0.75 inches and from the beginning of the bent portion to the end of the bent portion forms an arc of curvature between about 120 to about 220 degrees.

In Example 20, the method of any one or any combination of Examples 18-19 can optionally be configured such that the first side shell and the second side shell include at least three baffles, and the muffler includes at least two assemblies each having first, second, and third plates.

In Example 21, the muffler or the method of any one or any combination of Examples 1-20 can optionally be configured such that all elements, operations, or other options recited are available to use or select from.

The above Detailed Description includes references to the accompanying drawings, which form a part of the Detailed Description. The drawings show, by way of illustration, specific embodiments in which the present instrument use counters and methods can be practiced. These embodiments are also referred to herein as "examples."

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In this document, the terms "a" or "an" are used to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "about" and "approximately" are used to refer to an amount that is nearly, almost, or in the vicinity of being equal to a stated amount.

What is claimed is:

1. A muffler for an exhaust system comprising:

a muffler body including an exterior metal shell having an outer surface and an inner surface, a portion of the inner surface defining a gas chamber, the gas chamber configured such that exhaust gases flow in a direction from an inlet end to an outlet end, the gas chamber having a first side portion and a second side portion;

a plurality of baffles, each baffle coupled to the inner surface, each baffle extending from an outer end to an inner end, the inner end of at least one of the plurality of baffles having a reflecting portion bent in the direction of gas flow, wherein a first baffle of the plurality of baffles is coupled to the first side portion and a second baffle of the plurality of baffles is coupled to the second side portion;

a flow channel formed between the bent end of the first baffle coupled to the first side portion and the second baffle coupled to the second side portion; and a first plate assembly, coupled to the inner surface, the first plate assembly having a planar surface substantially parallel to the flow channel, wherein the first plate assembly includes a stacked configuration of a first plate located adjacent the flow channel, a second plate, and a third plate having a planar surface located adjacent the exterior metal shell, the second plate located between the first plate and the third plate.

2. The muffler of claim 1, wherein a number of baffles coupled to the first side portion is equal to a number of baffles coupled to the second side portion.

3. The muffler of claim 1, wherein the first side portion includes an even number of baffles and the second side portion includes an odd number of baffles.

4. The muffler of claim 1, wherein the reflecting portion of the at least one baffle coupled to the first side portion is generally across from a reflecting portion of a corresponding baffle coupled to the second side portion.

5. The muffler of claim 1, wherein the reflecting portion of the at least one baffle coupled to the first side portion is generally across from a space defined by at least one baffle coupled to the second side portion and one of a second baffle coupled to the second side portion and an end cap.

6. The muffler of claim 1, wherein the muffler body, the plurality of baffles and the first plate assembly include stainless steel.

7. The muffler of claim 1, wherein the reflecting portion includes a radius between about 0.25 to about 0.75 inches and from the beginning of the reflecting portion to the end of the reflecting portion forms an arc of curvature between about 120 to about 220 degrees.

8. The muffler of claim 1, comprising a welded center seam joining the first side portion to the second side portion.

9. The muffler of claim 1, comprising an inlet end cap and an outlet end cap, the inlet end cap coupled to the inlet end of the muffler body and defining an intake aperture, the outlet end cap coupled to the outlet end of the muffler body and defining an exhaust aperture.

10. The muffler of claim 9, comprising an inlet pipe coupled to the inlet end cap and an outlet pipe coupled to the outlet end cap.

11. The muffler of claim 1, wherein the muffler body includes a longitudinal axis substantially parallel to sides of the muffler body and each baffle is attached to the inner surface of the muffler body such that a planar portion of the baffle is at an angle in the between about 30 to about 90 degrees to the longitudinal axis.

12. The muffler of claim 1, wherein the first plate includes a bent portion at each end, the bent portion coupled to ends of the second plate and the third plate.

13. The muffler of claim 1, wherein the first plate assembly includes a plurality of perforations in the planar surface.

14. The muffler of claim 1, further comprising a second plate assembly, coupled to the inner surface, the second plate assembly having a planar surface substantially parallel to the flow channel.

15. A muffler for an exhaust system comprising: a muffler body including an exterior metal shell having an outer surface and an inner surface, a portion of the inner surface defining a gas chamber, the gas chamber configured such that exhaust gases flow in a direction from an inlet end to an outlet end, the gas chamber having a first side portion and a second side portion; an inlet end cap having an intake aperture, the inlet end cap coupled to the inlet end of the muffler body; an outlet end cap having an exhaust aperture, the outlet end cap coupled to the outlet end of the muffler body; a plurality of baffles, each baffle coupled to the inner surface, each baffle extending from an outer end to an inner end, the inner end of at least one of the plurality of baffles having a reflecting portion bent in the direction of gas flow, wherein a first baffle of the plurality of baffles is coupled to the first side portion and a second baffle of the plurality of baffles is coupled to the second side portion; a longitudinal axis substantially parallel to first and second sides of the muffler body, wherein each baffle is attached to one of the first side and the second side of the muffler body such that a planar portion of the baffle is at an angle between about 30 to about 90 degrees to the one of the first side and the second side; a flow channel formed between the bent ends of the first at least one baffle coupled to the first side portion and the second at least one baffle coupled to the second side portion; a first plate assembly having a planar surface substantially parallel to the flow channel, the first plate assembly coupled to the left portion near the outlet end of the muffler body, wherein the first plate assembly includes a stacked configuration of a first plate located adjacent the flow channel, a second plate, and a third plate having a planar surface located adjacent the exterior metal shell, the second plate located between the first plate and the third plate.

16. The muffler of claim 15, wherein the first side portion includes an even number of baffles and the second side portion includes an odd number of baffles.

17. A method of manufacturing a muffler comprising:

forming a muffler body first side shell extending from a first end to a second end, the first end having a first flange, the second end having a second flange;

coupling at least one baffle to a first inner surface of the first side shell, the at least one baffle extending from an outer end to an inner end, the inner end bent in a direction of exhaust flow, the at least one baffle attached at an angle to the first inner surface, wherein the angle is in between about 50 to about 70 degrees;

forming a muffler body second side shell extending from a third end to a fourth end, the third end having a third flange, the fourth end having a fourth flange;

coupling at least one baffle to a second inner surface of the second side shell, the at least one baffle extending from an outer end to an inner end, the inner end bent in a direction of exhaust flow, the at least one baffle attached at an angle to the second inner surface, wherein the angle is in between about 50 to about 70 degrees;

forming a first plate having edges that conform to the first inner surface;

bending the edges of the first plate to define a space for location of a second plate and a third plate;

attaching the second plate and the third plate to the first plate;

attaching the first plate to the first inner surface;

cutting at least one aperture in an inlet end cap;

cutting at least one aperture in an outlet end cap;

coupling the first side shell to the second side shell to form a complete shell;

coupling the inlet end cap to the complete shell; and coupling the outlet end cap to the complete shell.

18. The method of claim 17, wherein the bent inner end of the at least one baffle includes a radius between about 0.25 to about 0.75 inches and from the beginning of the bent portion to the end of the bent portion forms an arc of curvature between about 120 to about 220 degrees.

19. The method of claim 17, wherein the first side shell and the second side shell include at least three baffles, and the muffler includes at least two assemblies each having first, second, and third plates.

* * * * *